United States Patent [19]

Hruska et al.

[11] 3,987,636

[45] Oct. 26, 1976

[54] METHODS AND APPARATUS FOR ANCHORING A SUBMERGED STRUCTURE TO A WATERBED

[75] Inventors: Stanley J. Hruska; Albert M. Koehler, both of Houston, Tex.

[73] Assignee: Brown & Root, Inc., Houston, Tex.

[22] Filed: Apr. 30, 1975

[21] Appl. No.: 573,024

[52] U.S. Cl. ..... 61/100; 61/50; 61/53.52; 61/53.6

[51] Int. Cl.[2] ..... E02B 17/00; E02D 5/30; E02D 5/44

[58] Field of Search ..... 61/46.5, 46, 50, 53.6, 61/53.52, 53.5

[56] References Cited

UNITED STATES PATENTS

| | | | |
|---|---|---|---|
| 3,209,544 | 10/1965 | Borrmann | 61/46.5 |
| 3,213,629 | 10/1946 | Manning | 61/46 X |
| 3,677,113 | 7/1972 | Bowleg | 61/46 |

*Primary Examiner*—Jacob Shapiro

[57] ABSTRACT

An offshore tower is anchored to a water bed by inserting piling elements into piling jackets located at the tower base and driving the piling elements into the water bed. Grouting material is poured between each jacket and piling element to bond these members together. Grouting material is also poured into the tubular piling elements and into a bell-shaped cavity located therebelow to form a bell footing which anchors the piling element to the water bed. A metallic reinforcement tube which is at least one-half the diameter of the piling element, is inserted into the piling element so as to extend between the piling element and the bell footing. The reinforcing tube presents considerable grouting-encased surface area extending between the piling element and the bell footing to maximize the connection therebetween. In addition, the reinforcing tube effectively reinforces the grouting material against tension, compression, and torsion. Spirally arranged weld beads are affixed to the piling jacket, the piling element, and the reinforcing tube. These weld beads become embedded within the hardened grouting material to firmly secure the tubular elements against longitudinal movement.

10 Claims, 12 Drawing Figures

FIG. 1
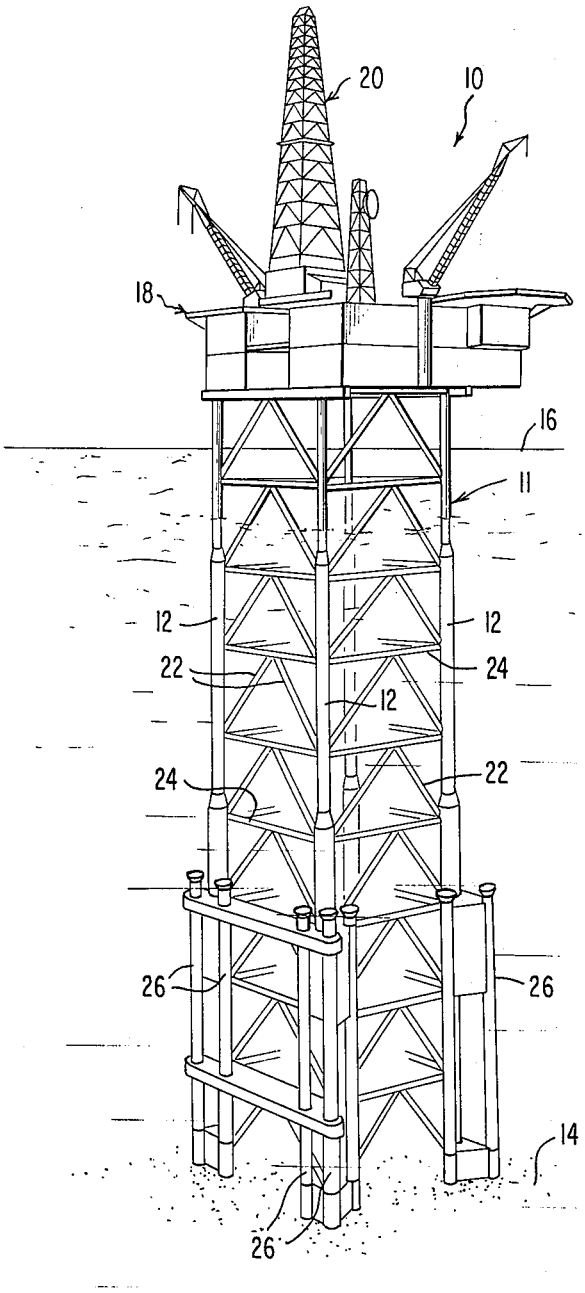
FIG. 2
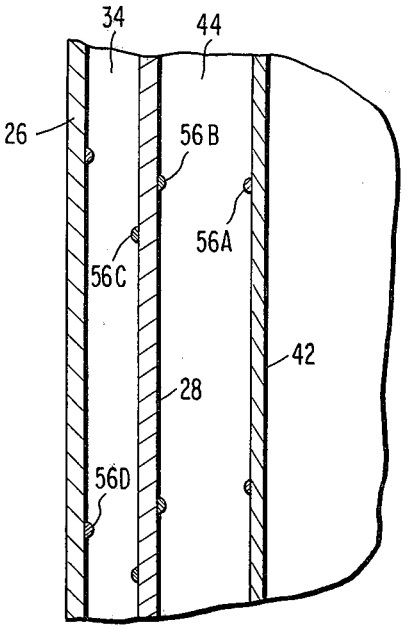
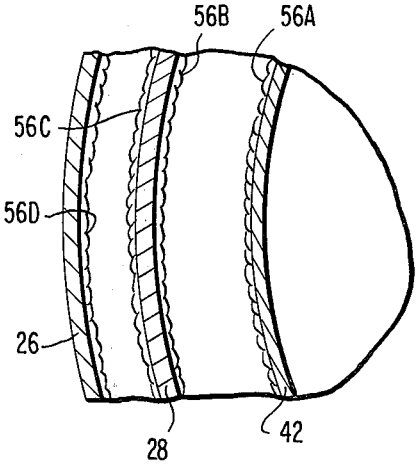
FIG. 3

METHODS AND APPARATUS FOR ANCHORING A SUBMERGED STRUCTURE TO A WATERBED

BACKGROUND AND OBJECTS OF THE INVENTION

The present invention relates to an offshore tower assembly and, more specifically, to apparatus and methods for anchoring an offshore tower to a earth earch formation.

Numerous offshore activities, such as those relating to the exploration for, and recovery of, offshore oil deposits for example, require the use of water-based facilities for housing equipment and personnel. In this connection, the recovery of oil deposits from submerged earth formations is generally carried out from a tower which is anchored to the submerged earth formation and which includes a platform disposed above the water surface. In order to provide stability and safety for the offshore operations, the tower must be firmly anchored relative to the submerged earth formation.

One conventional technique for anchoring an offshore tower to a submerged earth formation comprises driving a plurality of pilings into the earth formation and operably coupling these pilings to the legs of the tower. Thus the tower is, in effect, pinned to the water bed. The pilings can be affixed within the submerged earth formation by embedding the pilings in grouting material such as concrete or cement. Attention is directed to techniques described in U.S. Pat. Nos. 3,209,544 (issued Oct. 5, 1965); 3,315,473 (issued Apr. 25, 1967); 3,488,967 (issued Jan. 13, 1970); 3,528,254 (issued Sept. 15, 1970); 3,585,801 (issued June 22, 1971); and 3,677,113 (issued July 18, 1972), as being exemplary of such practice.

Once erected, the tower will likely be subjected to the effects of rough waves, high winds, and other natural and operations-related phenomenon which impart relatively high tensile and compressive stressing on the anchoring piles. Such high stressing is especially prevalent in the North Sea, for example.

In order to strengthen the grouted pilings to more effectively resist these loads, it is conventional to apply reinforcing structure to the grouting material. Such reinforcement has been heretofore accomplished, in one known technique, by embedding within the grouting material a plurality of metal rods, or re-bars, held together by a cage structure of some sort. This arrangement is necessarily long in size and typically is extremely flexible and very hard to transport and manipulate. Much difficulty is usually encountered when trying to pick up such an arrangement from a barge deck and lower it through water and into a piling casing. The effect of these wasted man-hours is especially felt in conjunction with the high cost associated with offshore tower operations.

In addition, bell-shaped grouted footings may be employed to anchor the pilings to the water bed. Since relatively short pilings may be used in conjunction with such footings, the importance of establishing a secure connection between the piling and the bell footing is amplified.

It is, therefore, an object of the present invention to obviate or minimize problems of the previously discussed type.

It is another object of the invention to maximize the strength and integrity of an offshore, anchored foundation piling.

It is yet another object of the invention to provide novel apparatus and methods for reinforcing offshore, grout-held foundation pilings.

It is a further object of the invention to provide such methods and apparatus which are economical and uncomplicated and which augment the anchoring action heretofore realized.

It is still another object of the invention to maximize the connection between a piling and a bell footing.

It is a further object of the invention to provide such methods and apparatus which entail a metallic reinforcement tube encased within a tubular piling and a bell footing, and spiral weld beads on the tubular elements embedded within grouting material.

BRIEF SUMMARY OF A PREFERRED EMBODIMENT OF THE INVENTION

A preferred form of the invention intended to accomplish at least some of the foregoing objects entails an offshore foundation assembly which includes a support frame located within a body of water. A plurality of guide jackets carried by the support frame is disposed adjacent a submerged earth formation covered by the body of water. Tubular metallic piling elements are disposed within and coupled to the guide jackets. The lower ends of the piling elements project into the submerged earth formation. A metallic reinforcing tube is disposed within each of the piling elements. The reinforcing tube has a width which is at least one-half the width of the piling element. The reinforcing tube is oriented such that a lower end thereof projects into a cavity located in the submerged earth formation adjacent the lower end of a respective piling element. The cavity is of a width greater than the width of its associated piling element. Each cavity contains hardened grouting material which defines a grouted footing. The grouting material extends upwardly within the reinforcing tube and between the reinforcing tube and the piling element so that an inner surface of the piling element and inner and outer surfaces of the reinforcing tube are embedded within the grouting material to firmly secure the piling element to the grouted footing.

Preferably, spirally arranged weld beads are installed on the tubular members to become embedded within hardened grouting material and resist longitudinal movement.

An important aspect of the invention involves a method for installing the foundation assembly. The method includes positioning a support frame within a body of water such that guide jackets located at the lower end thereof are disposed adjacent a submerged earth formation covered by the body of water. A tubular, metallic piling element is installed through each of the jackets. The lower ends of the piling elements are driven into the submerged earth formation. A cavity is excavated in the earth formation adjacent the lower ends of each of the piling elements such that the width of the cavity is greater than the width of an associated piling member. A metallic reinforcing tube is inserted into each piling element such that a lower end of the reinforcing tube projects into the cavity. Grouting material is introduced into the cavity to define, when hardened, a grouted footing. Grouting material is continued to be introduced so that the grouting material extends upwardly within the reinforcing tube and between the reinforcing tube and the piling element. This is effected so that the inner surface of the piling element and the outer and inner surfaces of the reinforcing tube are embedded within the grouting material to firmly secure the piling element to the grouted footing.

BRIEF DESCRIPTION OF THE DRAWINGS

FIG. 1 is a side elevational view of a tower assembly anchored within a body of water in accordance with the present invention;

FIG. 2 is a fragmentary, longitudinal sectional view taken through a piling jacket prior to the insertion of grouting material;

FIG. 3 is a fragmentary, cross-sectional view of a piling jacket prior to the insertion of grouting material;

DETAILED DESCRIPTION OF THE PREFERRED EMBODIMENT

Figure 4:
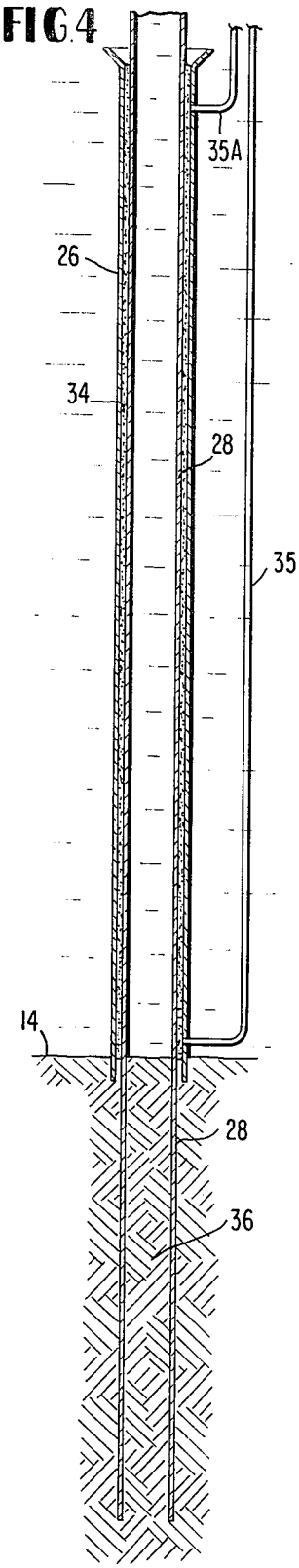
FIGS. 4 through 7 are longitudinal sectional views taken through a piling jacket, depicting various stages involved in anchoring the piling jacket to a submerged earth formation.

Referring to the drawings, and particularly to FIG. 1, there is disclosed a preferred embodiment of the invention. In this connection, an offshore tower assembly 10 is disclosed which is similar to that disclosed in pending U.S. Koehler et al. application Ser. No. 354,470, filed Apr. 25, 1973, now U.S. Pat. No. 3,859,804, issued Jan. 14, 1975 and assigned to the assignee of this invention. The disclosure of that Koehler et al application is incorporated herein by reference.

The offshore tower assembly 10 includes a support frame structure 11 having a plurality of generally vertical columns or legs 12 which rest on the surface of a submerged earth formation 14. Upper ends of these legs 12 extend above a body of water 16 which covers the earth formation 14 and are designed to support an operating platform 18 in a generally horizontal posture. The platform 18 may be of the multi-level type suitable for carrying living quarters and technical equipment, such as radar or oil drilling equipment, for example. In the event that the tower is utilized for the offshore drilling of oil, the platform may contain drilling rigs 20 with the attendant equipment necessary to sustain extended drilling operations in a plurality of locations around the base of the tower.

The generally vertical legs 12 are interconnected with diagonal support and bracing struts 22 deployed along the length of the legs. Horizontal bracing members 24 are further employed at various levels along the length of the legs to enhance the stability of the tower structure.

The cross-sectional diameter of the legs may be suitably dimensioned to accommodate a progressively increasing load which must be supported by the legs.

Attached at the lower ends of the legs 12 are clusters of pile jackets 26. These jackets serve to guide and house pilings 28 which pin the tower to the submerged earth formation, as will be further discussed hereinafter in more detail. The piling jackets 26 are secured by welding to the respective legs 12 of the support frame structure 11.

The tower 10 is assembled by sinking the support frame 11 to an upright posture sitting on the submerged earth formation. The support structure is then anchored to the earth formation, and the platform assembly 18 is seated thereon. Various details pertaining to some of these erection procedures are explained more fully in the previously-mentioned Koehler et al application.

Figure 9:
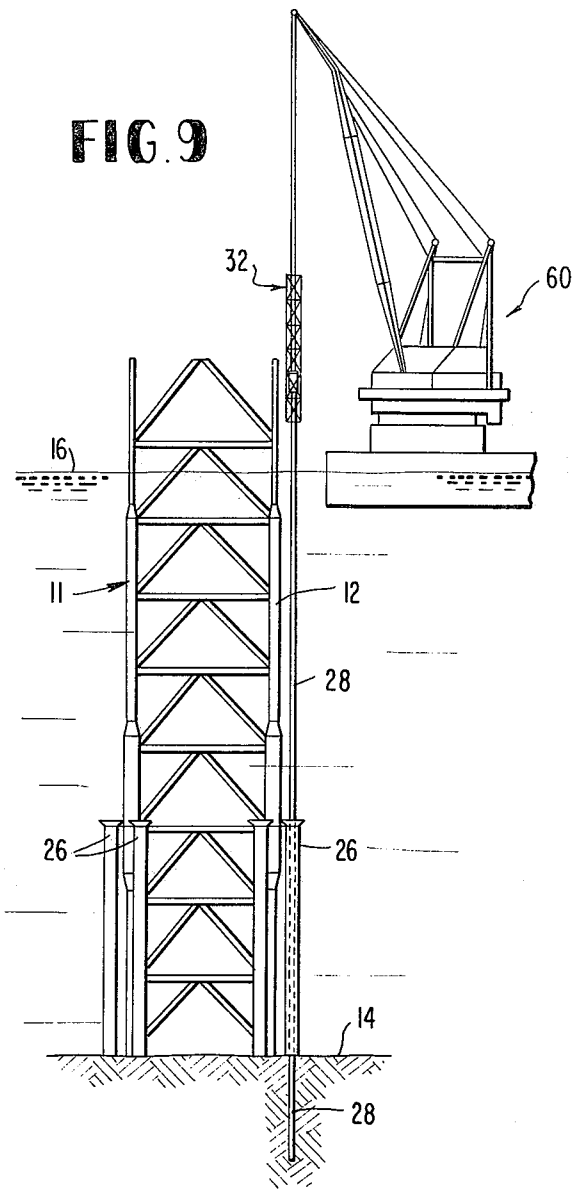

FIGS. 4–7 illustrate schematically various phases of anchoring the support frame structure 11 to the earth formation 14. It should be pointed out that when the support structure 11 is seated on the submerged earth formation, the piling jackets 26 may be oriented vertically or at a slight angle relative to vertical, depending upon the configuration of the support frame 11. Each piling jacket 26 of the preferred embodiment comprises a generally vertically disposed metallic tubular member which extends from the submerged earth formation 14 to a submerged level thereabove. The pile jacket 26 is designed to receive a piling element 28 which is driven through the jackets and into the submerged earth formation by appropriate pile driving equipment 32 (FIG. 9).

The piling element 28 comprises a steel tubular member which is related in diameter to the jacket 26 such that a concentric space 34 is formed between the outer surface of the piling and the inner surface of the jacket. This space is suitably filled with grouting material, such as concrete or cement for example, supplied through a conduit 35, to fixedly couple together the jacket and the piling and thereby secure the support frame 11 to the submerged earth formation.

Figure 11:
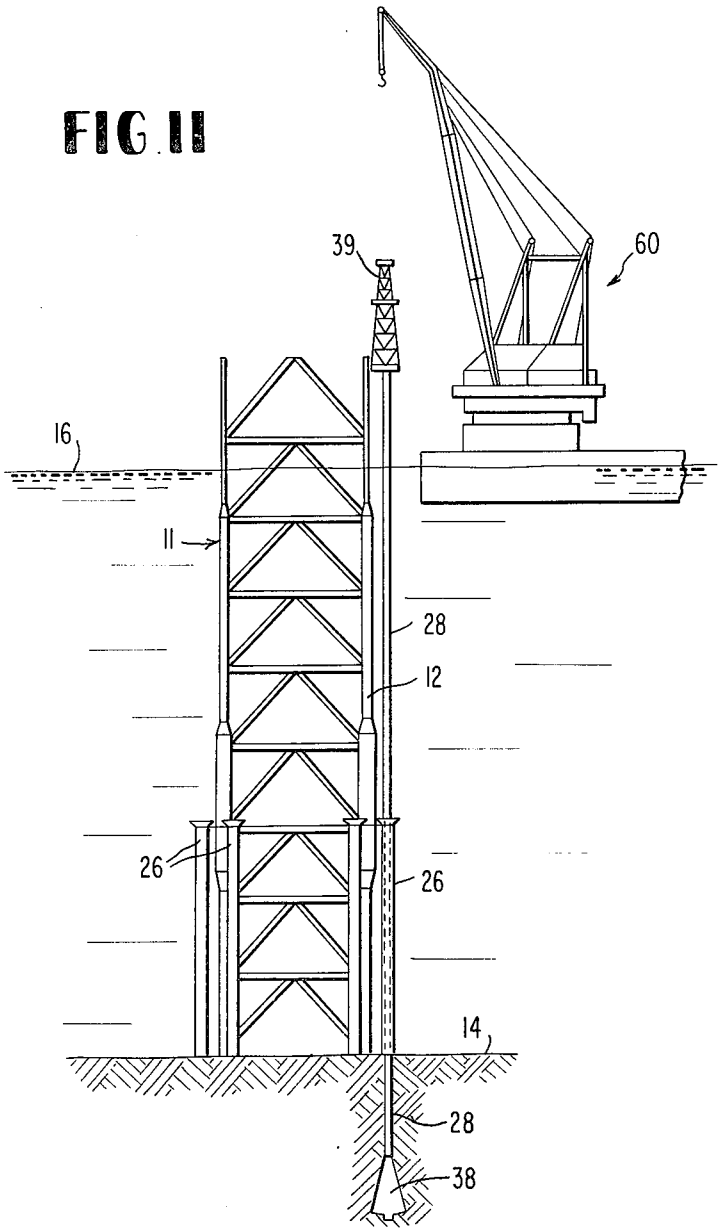

A reaming tool of a suitable conventional type excavates and removes that part 36 of the earth formation disposed within the lower extent of the piling 28. Operation of the tool can be effected by equipment carried by an excavating tower 39 (FIG. 11). The tool continues downwardly to excavate earth from below the bottom end of the piling 28 to form a generally bell-shaped cavity 38. The cavity 38 is wider than the width, or diameter, of the piling 28 and is arranged to receive a charge of grouting material 40. As will be subsequently described, the grouting material is to occupy the cavity 38 to form a bell footing and extend upwardly within the piling 28 to affix the piling rigidly to the bell footing.

As noted previously, it is desirable to reinforce the grouted piling structure to resist the high tensile, compressive and torsional forces that are continually encountered during the life of the tower. Experience with known reinforcement structures has not been entirely suitable.

Accordingly, one feature of the present invention involves a novel offshore piling reinforcement insert. This insert comprises a steel reinforcing tube 42. Preferably, the tube 42 is of one-piece design and can be fabricated by rolling and welding a solid piece of sheet steel, for example. The length of the tube 42 is sufficient to enable an upper part of the tube to lie within the piling 28 while its lower part rests on the bottom of the cavity 38. In diameter, the tube 42 is dimensioned to fit within the piling 28, with the outer surface of the tube being spaced from the inner surface of the piling to define an area 44 therebetween. The reinforcing tube diameter is at least one-half the diameter of the piling 28.

Figure 8:
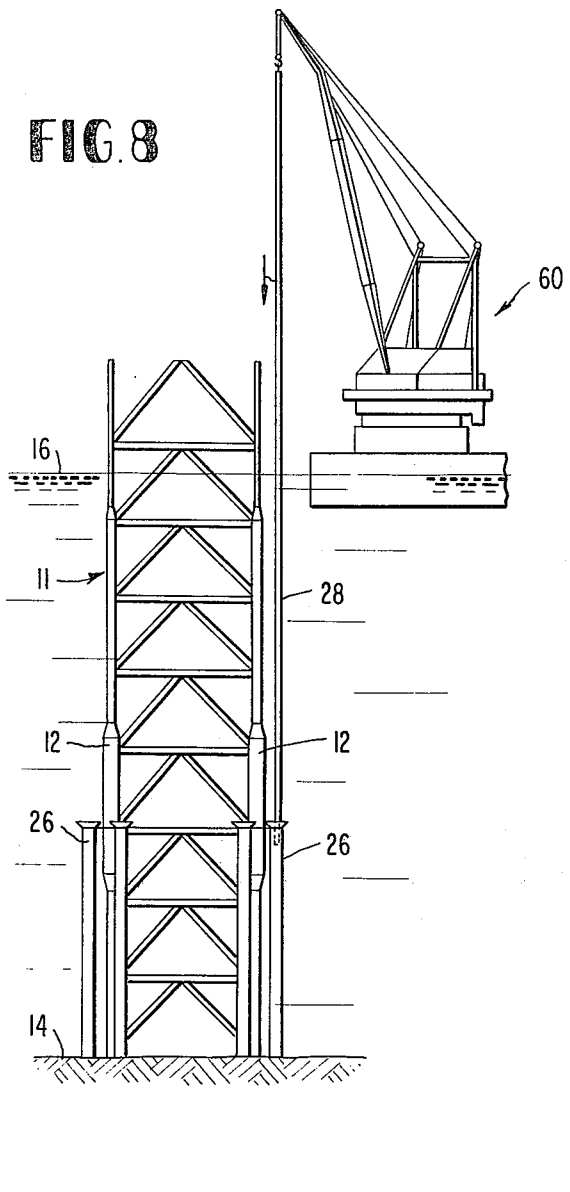

The tube 42 is arranged to be picked up at one end and lowered through the piling 28 (see FIG. 8). Due to its relatively stiff nature, the reinforcing tube 42 is relatively easy to pick up, manipulate within the water, and insert into the piling.

The reinforcing tube 42 descends until its lower end rests upon the bottom of the bell-shaped cavity 38, with its upper end extending upwardly well into the piling 28.

In order to bond the reinforcing tube 42 to the piling 28, grouting material 40 is pumped through the piling and into the cavity so as to occupy the cavity and extend upwardly within the reinforcing tube and within the area 44 to a distance above the surface of the submerged earth formation 14. Once having hardened, the grouting in the cavity 38 defines a bell-shaped footing 50 to which is secured the piling 28. Importantly, the reinforcing tube 42 reinforces the grouting material against tension, compression, and torsional stressing. In addition, the tube 42 augments the coupling action between the piling 28 and the bell-shaped footing 50. Due to the relatively wide radius and solid wall construction of the reinforcing tube 42, this reinforcement and coupling action augmentation is considerable.

In another significant aspect of the present invention, novel structure is provided for maximizing the bond between the tubular elements 26, 28, and 42. This structure comprises a plurality of weld beads 56(A–D) (FIGS. 2 and 3). The weld beads 56A are provided on the outer surface of the reinforcing tube 42; weld beads 56B and C are placed on the inner and outer surfaces of the piling 28; and weld beads 56D are disposed on the inner surface of the jacket 26. The weld beads are sized to terminate short of the oppositely disposed one of the tubular members 26, 28, 42 toward which the weld beads project. Once the grouting material has been poured and hardened to bond the tubular members 26, 28, 42 together, the weld beads will be encased within the grouting material to effectively resist longitudinal movement of the tubular members.

The weld beads can be quickly and economically deposited on the respective cylindrical surfaces of conventional pipe-welding techniques. The weld beads are relatively small in size, preferably ¼ inch thick, and generally smooth in profile so as to present minimal interference with the passage of objects through the tubular members as well as passage of the tubular members through each other.

Although the beads can be formed as circular rings spaced along the inner wall of the tubular members, one particularly advantageous configuration of the weld bead is that of a spiral pattern along the length of the tubular members. It has been found that such a pattern presents minimal interference, with the longitudinal movement of the tubular members relative to one another. For example, the pilings 28 can be slipped through the jackets 26 with minimal obstruction, the same applying to passage of the reinforcing tube 42 through the jackets 26. The weld bead spirals can be generated in the same or opposite directions relative to an opposing weld bead spiral. In sum, the weld beads provide a highly secure connection with minimum aggravation and lost man-hours occurring during installation of the footing assemblies.

INSTALLATION

Figure 10:
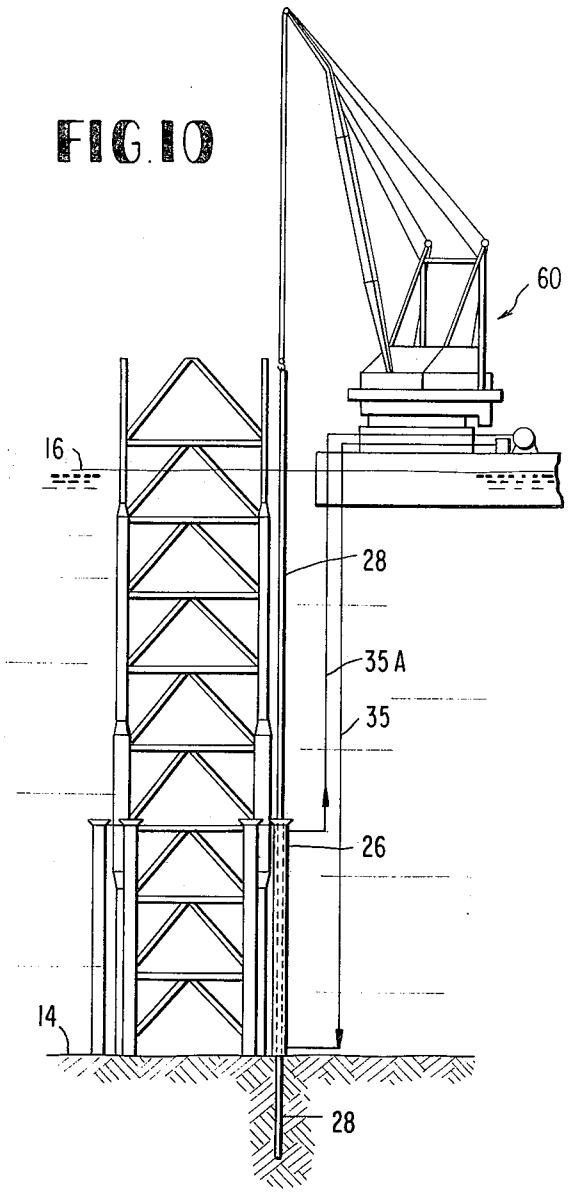
FIGS. 8 through 12 are side elevational views of an offshore tower and a support barge, depicting various stages involved in anchoring the tower to a submerged earth formation.

Installation of the offshore tower 10 is schematically depicted in FIGS. 8–12. FIG. 8 depicts a condition wherein the support frame structure 11 has been laid on the submerged earth formation 14 via known techniques such as those disclosed in the aforementioned Koehler et al application. A derrick-type support barge 60 serves to lower a piling 28 downwardly through a piling jacket 26 (FIG. 8). With the lower end of the piling 28 resting on the surface of the submerged earth formation, a conventional pile-driving apparatus 32 drives the pile 28 into the submerged earth formation (FIG. 10). Suitable conduits 35, 35A are attached to the upper and lower ends of the jacket 26 (FIGS. 4 and 10) and grouting material is passed therethrough into the area 34 between the jacket 26 and the piling 28. Once having hardened, this grouting material serves to effectively bond the casing 28 to the jacket 26.

Figure 5:
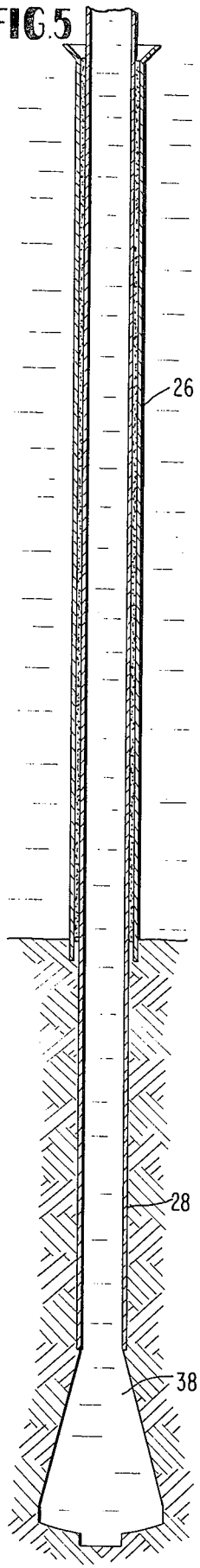

Excavating equipment, controlled from structure 39, is employed to remove earth from within the lower end of the piling 28 and to form the bell-like cavity 38 below the piling 28 (FIGS. 5 and 11).

Figure 6:
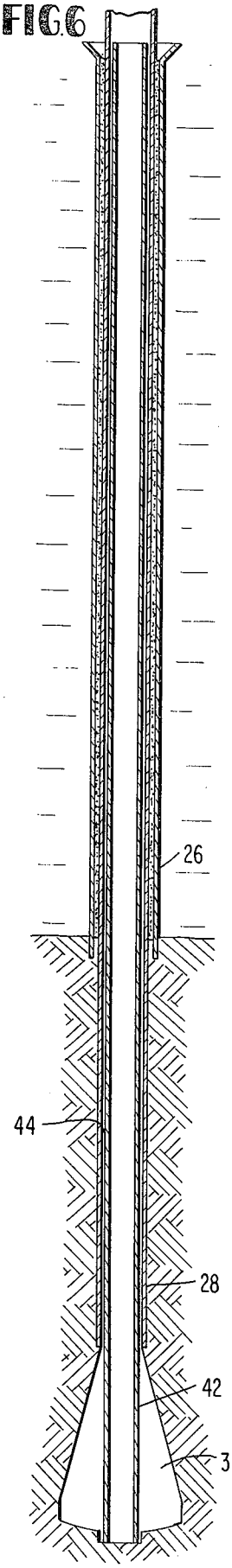
Figure 7:
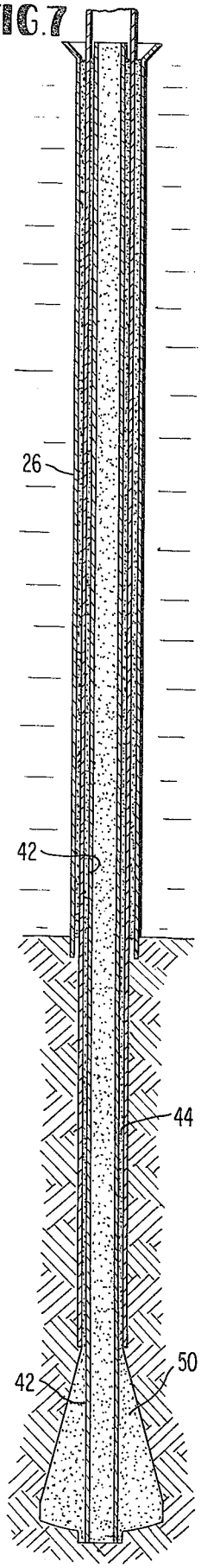
Figure 12:
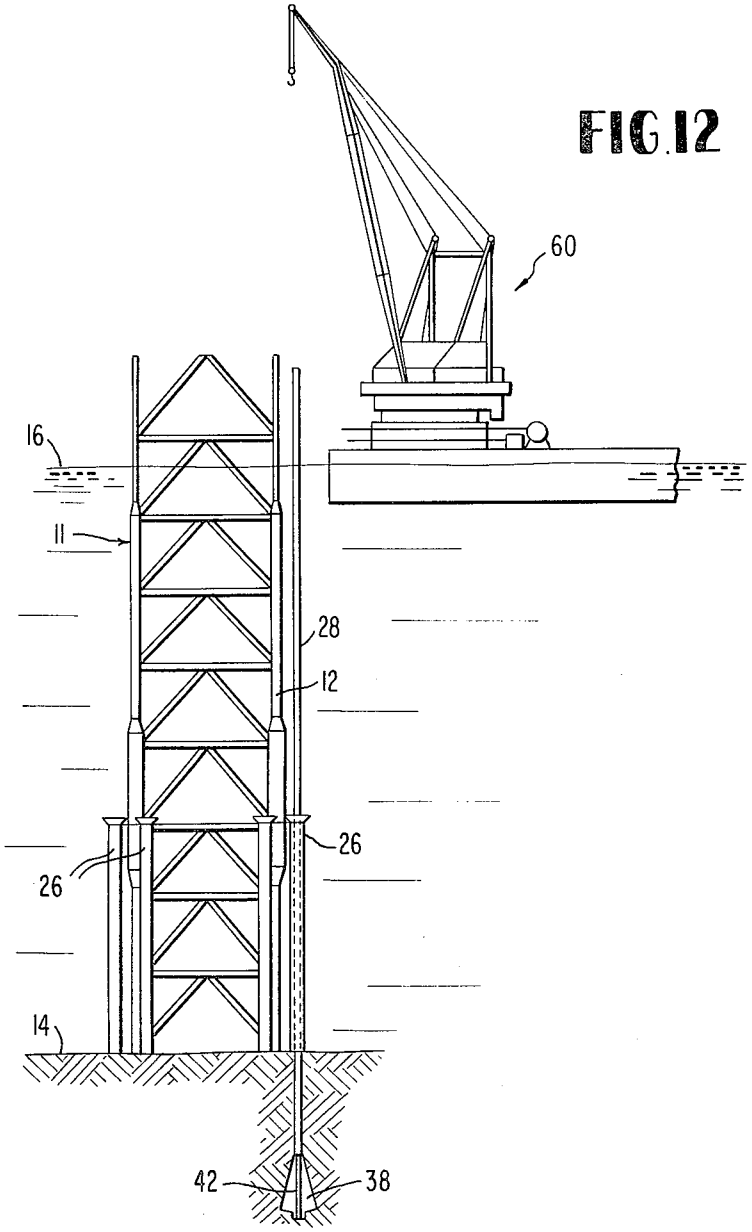

Subsequently, a reinforcement tube 42 is lowered downwardly through the piling until it rests upon the base of the cavity 38 (FIGS. 6 and 12). With the reinforcing tube thus disposed in place, grouting material is introduced into the piling 28 and into the area 44 between the piling and the reinforcing tube 42 such that the piling 28, the cavity 38, and the area 44 are filled with grouting material to a distance above the surface of the submerged earth formation 14. This can be accomplished in numerous ways, such as by lowering a hose into the piling and pumping grouting material through the hose, for example.

With this accomplished, the portion of the piling 28 located above the top of the jacket 26 is severed by suitable cutters and this severed portion is hoisted onto the derrick barge 60.

This procedure is repeated until all of the piles 28 are inserted to pin the support frame 11 to the submerged earth formation. Once accomplished, the platform assembly 18 can be installed at the top of the frame structure 11 above the surface of the body of water 16.

SUMMARY OF MAJOR ADVANTAGES AND SCOPE OF THE INVENTION

The grouted piles firmly anchor the tower structure to the submerged earth formation, with reinforcement of the grouted piles having been accomplished smoothly and with minimal installation difficulty by the easily handled reinforcing tubes. The reinforcing tubes produce tension, compression, and torsional reinforcement of the grouting. Each reinforcing tube extends between the bell footing and the piling and, in being at least one-half the width of the piling element, presents considerably surface area encased within the grouting material to maximize the connection between the pile and its associated bell footing. In this fashion, securement of the pilings within the submerged earth formation is intensified to compensate for the use of relatively short pilings in conjunction with the bell footing.

Anchoring of the tubular elements within the grouting material is further fortified by the shear-resisting weld beads. These beads are easily and economically applied to the tubular members and present a relatively rounded configuration to minimize interference when passing one tubular member through another. Such minimal interference is further enhanced by the spiral arrangement of the weld beads.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. An offshore tower assembly comprising:

frame means located within a body of water and carrying operating facilities;

a plurality of guide jacket means carried by said frame means and being disposed adjacent a submerged earth formation covered by said body of water;

tubular metallic piling elements disposed within and coupled to respective ones of said guide jacket means, with the lower ends thereof projecting into said submerged earth formation;

a metallic reinforcing tube disposed within each of said piling elements, said reinforcing tube being at least one-half the width of its associated piling element, the lower end of said reinforcing tube projecting into a cavity located in said submerged earth formation adjacent the lower end of a respective piling element; said cavity being of a width greater than the width of an associated piling element;

each cavity containing hardened grouting material which defines a grouted footing, said grouting material extending upwardly within said reinforcing tube and between said reinforcing tube and said piling element so that an inner surface of said piling element and inner and outer surfaces of said reinforcing tube are embedded within said grouting material to firmly secure said piling element to said grouted footing; and each said reinforcing tube projecting downwardly through the interior of said hardened grouting material, substantially to the base of said cavity, and providing internal, tensional, compressional, and torsional reinforcing for said grouted footing.

2. An offshore tower assembly according to claim 1 wherein said inner and outher surfaces of each reinforcing tube, and the inner surface of each piling element carry weld beads which are embedded within said grouting material to resist longitudinal movement of said reinforcing tubes and said piling elements.

3. An offshore tower assembly according to claim 2 wherein a space between the inner surface of each jacket means and the outer surface of its associated piling element contains hardened grouting material to bond said piling element to said jacket means; said inner surface of said jacket means and said outer surface of said piling element each carrying a weld bead embedded within said last-named grouting material to resist longitudinal movement of said jacket means and said piling element.

4. An offshore tower assembly comprising:

support frame means including a plurality of support legs, said legs being disposed within a body of water;

an operating platform carried atop said support frame means;

a plurality of metallic tubular jacket members of circular cross-section affixed to lower ends of said legs, said jacket members being supported on a submerged earth formation covered by said body of water;

a plurality of metallic tubular pile members of circular cross-section disposed in said jacket members;

said pile members having lower ends disposed within said submerged earth formation, and upper ends disposed within said jacket members at a distance above the surface of said submerged earth formation;

said pile members having outer surfaces spaced inwardly from inner surfaces of associated jacket members to define first areas therebetween carrying hardened grouting material to bond said jacket members to said pile members; and a plurality of metallic reinforcing tubes of circular cross-section disposed in said pile members, an upper end of each reinforcing tube being situated above the surface of said submerged earth formation and a lower end of each reinforcing tube being located within a cavity in said earth formation, each cavity being located below a lower end of an associated pile member and having a width greater than the width of the pile member;

the diameter of each reinforcing tube being at least one-half the diameter of its associated pile member;

said reinforcing tubes having outer surfaces spaced inwardly from inner surfaces of associated pile members to define second areas therebetween carrying hardened grouting material to a distance above the surface of said submerged earth formation to bond said pile members to said reinforcing tubes;

each of said cavities being filled with grouting material to define a grouted footing encasing inner and outer surfaces of the lower end of an associated reinforcing tube to anchor said reinforcing tubes to said grouted footing;

said grouting material extending upwardly within said reinforcing tube to a distance above the surface of said submerged earth formation;

weld beads affixed to the inner surface of said jacket members, the outer and inner surfaces of said pile members, and the outer surface of said reinforcing tube;

said weld beads being embedded within said grouting material to resist longitudinal movement of said jacket members, said pile members, and said reinforcing tubes.

5. An offshore tower assembly according to claim 4 wherein said weld beads are arranged in a spiral pattern.

6. A method of erecting an offshore tower comprising the steps of:

positioning a support frame within a body of water such that guide jackets located at the lower end thereof are disposed adjacent a submerged earth formation covered by said body of water;

installing a tubular, metallic piling element through each of said jackets;

driving the lower ends of said piling elements into the submerged earth formation;

excavating a cavity in said earth formation adjacent the lower ends of each of said piling elements such that the width of said cavity is greater than the width of an associated piling member;

inserting a metallic reinforcing tube into each piling element such that a lower end of said reinforcing tube projects into said cavity;

introducing grouting material into said cavity to define, when hardened, a grouted footing;

continuing to introduce grouting material so that said grouting material extends upwardly within said reinforcing tube and between said reinforcing tube and said piling element so that an inner surface of said piling element and outer and inner surfaces of said reinforcing tube are embedded within said grouting material to firmly secure said piling element to said grouted footing.

7. A method according to claim 6 including, prior to positioning said support frame within said body of water, the step of installing weld beads on the inner and outer surfaces of each reinforcing tube and on the inner surface of each piling element; and said steps of introducing grouting material comprising the step of encasing said weld beads in said grouting material so that said grouting material, when hardened, resists longitudinal movement of said reinforcing tubes and said piling elements.

8. A method according to claim 7 including, prior to positioning said support frame within said body of water, the step of installing weld beads on the inner surface of each guide jacket and on the outer surface of each piling element; and introducing grouting material between each jacket and its respective piling element such that when said grouting material hardens, said last-named weld beads are encased within said grouting to resist longitudinal movement of said guide jackets and said piling elements.

9. A method according to claim 8 wherein at least some of said steps of installing weld beads comprises installing said weld beads in a spiral pattern.

10. A method for erecting an offshore tower assembly comprising the steps of:

positioning a support frame means in a body of water such that a plurality of generally vertical legs thereof extend below water surface;

installing an operating platform atop said support frame means;

affixing a plurality of metallic, tubular jacket members of circular cross-section to lower ends of said legs, such that said jacket members are supported on a submerged earth formation covered by said body of water, the inner surface of said jacket members carrying weld beads;

inserting a plurality of metallic, tubular pile members of circular cross-section through said jacket members, the inner and outer surfaces of said pile members carrying spirally arranged weld beads;

driving said pile members downwardly so that:

lower ends thereof are disposed in said submerged earth formation, upper ends thereof are disposed within said jacket members at a distance above the surface of said submerged earth formation, and the outer surfaces of said pile members are spaced inwardly from the inner surfaces of associated jacket members to define first spacing therebetween;

introducing grouting material into said first spacing of each jacket member so that, when hardened, said weld beads disposed on said guide jackets are embedded in said grouting material and said pile members are bonded to said guide jackets;

removing earth from said pile members and excavating a cavity below said pile members so that said cavity has a width greater than the width of associated pile members;

inserting into each pile member a metallic reinforcing tube of circular cross-section and of a diameter which is greater than one-half the diameter of its associated pile member so that:

an upper end of said reinforcing tube is situated above the surface of said submerged earth formation, a lower end of said reinforcing tube is located within an associated one of said cavities, and an outer surface of said reinforcing tube is spaced inwardly from the inner surface of an associated pile member to define second spacing therebetween;

introducing grouting material into each cavity until said grouting occupies said cavity and extends upwardly within each reinforcing tube and within said second spacing to a selected distance above the surface of said submerged earth formation to:

encase inner and outer cylindrical surfaces of said reinforcing tube to firmly anchor said pile members to said grouted footing and encase said weld beads carried by said pile member and said reinforcing tube to resist longitudinal movement of said pile member and said reinforcing tube.

* * * * *